US007621808B2

(12) United States Patent
Walker et al.

(10) Patent No.: US 7,621,808 B2
(45) Date of Patent: Nov. 24, 2009

(54) AFRICAN AMERICAN BOARD GAME SYSTEM AND METHOD

(76) Inventors: Shandra L. Walker, 2805 Dartmouth La., Olympia Fields, IL (US) 60461; Cetrina L. Walker, 2805 Dartmouth La., Olympia Fields, IL (US) 60461

( * ) Notice: Subject to any disclaimer, the term of this patent is extended or adjusted under 35 U.S.C. 154(b) by 402 days.

(21) Appl. No.: 10/995,868

(22) Filed: Nov. 23, 2004

(65) Prior Publication Data

US 2005/0133995 A1 Jun. 23, 2005

Related U.S. Application Data

(60) Provisional application No. 60/524,794, filed on Nov. 25, 2003.

(51) Int. Cl.
*A63F 9/24* (2006.01)
*G09B 19/00* (2006.01)

(52) U.S. Cl. ..... 463/9; 463/1; 434/262

(58) Field of Classification Search ..... 273/429, 273/237; 434/322–364

See application file for complete search history.

(56) References Cited

U.S. PATENT DOCUMENTS 387,220 A 8/1888 Forker
3,504,913 A 4/1970 Bilotti
3,559,993 A 2/1971 Thomas
3,674,264 A 7/1972 Boercker
4,309,035 A 1/1982 Goldfarb
4,577,869 A 3/1986 Brinkman
4,640,513 A 2/1987 Montijo
4,729,564 A * 3/1988 Kuna et al. ..... 463/9
4,872,681 A 10/1989 Martin
4,988,108 A 1/1991 Shepard
4,998,735 A 3/1991 Blackwell
5,066,020 A 11/1991 Trudeau
5,085,439 A 2/1992 Lott
5,087,050 A 2/1992 Donovan
5,088,928 A * 2/1992 Chan ..... 434/339
5,122,062 A * 6/1992 Cutler et al. ..... 434/327
5,248,147 A 9/1993 Smith
5,257,939 A * 11/1993 Robinson et al. ..... 434/129
5,314,340 A * 5/1994 Gaddis ..... 434/327
5,377,990 A 1/1995 Seeney-Sullivan
5,454,569 A * 10/1995 Walker ..... 273/236
5,513,852 A 5/1996 Robinson
5,839,902 A * 11/1998 Wood ..... 434/130

(Continued)

OTHER PUBLICATIONS www.itsablackthang.com "Who Am I Black Trivia Game" dated Jan. 28, 2001.*

(Continued)

*Primary Examiner*—Peter DungBa Vo
*Assistant Examiner*—Masud Ahmed
(74) *Attorney, Agent, or Firm*—Lesavich High-Tech Law Group, P.C.; Stephen Lesavich

(57) ABSTRACT

An African American board game apparatus and method. The board game apparatus and method is specifically related to African American culture categories, including, but not limited to, history, language including slang, music, movies, sitcoms and sports. It includes an audio-visual device that allows electronic text, audio snippets and video snippets and electronic text to be displayed for trivia questions for selected time periods (e.g., 1960's, 1970's, 1980's, 1990's, etc.) related to African American culture.

19 Claims, 9 Drawing Sheets

U.S. PATENT DOCUMENTS

| | | | | |
|---|---|---|---|---|
| 6,224,057 | B1 * | 5/2001 | Morton | 273/272 |
| 6,394,899 | B1 | 5/2002 | Walker | |
| 6,443,840 | B2 | 9/2002 | Von Kohorn | |
| 6,752,396 | B2 | 6/2004 | Smith | |
| 2003/0008694 | A1 * | 1/2003 | Troy et al. | 463/1 |
| 2004/0072135 | A1 * | 4/2004 | Unsicker | 434/322 |
| 2004/0240861 | A1 * | 12/2004 | Yeend et al. | 386/125 |

OTHER PUBLICATIONS

NPL Handmark release of Trivial Pursuit on PDA's and Pocket PC.*
Wikipedia list of Trivial Pursuit release dates.*
How to play Trivial Pursuit.*

* cited by examiner

AFRICAN AMERICAN BOARD GAME SYSTEM AND METHOD

CROSS REFERENCES TO RELATED APPLICATIONS

The application claim priority to U.S. Provisional Application 60/524,794, filed Nov. 25, 2003, the contents of which are incorporated by reference.

COPYRIGHT NOTICE

Pursuant to 37 C.F.R. 1.71(e), applicants note that a portion of this disclosure contains material that is subject to and for which is claimed copyright protection, such as, but not limited to, digital photographs, screen shots, user interfaces, or any other aspects of this submission for which copyright protection is or may be available in any jurisdiction. The copyright owner has no objection to the facsimile reproduction by anyone of the patent document or patent disclosure, as it appears in the U.S. Patent Office patent file or records. All other rights are reserved, and all other reproduction, distribution, creation of derivative works based on the contents of the application or any part thereof are prohibited by applicable copyright law.

FIELD OF THE INVENTION

This invention relates to board games. More specifically, it relates to an African American board game apparatus and method.

BACKGROUND OF THE INVENTION

In the past decade, an increasing number of people have become interested in their racial and/or ethnic heritages. In the U.S., the availability of African-American, Native-American, Hispanic-American, etc. related products have increased dramatically.

One problem with these racial and/or ethic related products that there are few recreational products, such as board games. For example, there are only a few board games specifically directed to racial and/or ethnic groups including African American, Hispanic Americans, Native Americans, etc., in any format.

Another problem is that existing educational or recreational board games related to African American culture focus only on selected historical or educational topics. African American culture is rich in other areas including music, movies, language and sports. These topics have typically not been included in such African American culture board games.

There have been attempts to overcome some of the problems associated with racial and/or ethnic based board games. The following U.S. Patents and others have attempted to overcome some of these problems.

For example, U.S. Pat. No. 5,257,939 entitled "Cultural knowledge board game" that issued to Robinson, et al. includes educational and entertaining table game which has as its theme various educational categories, e.g., the Bible, mythology, folklore, literature, philosophy, religion, the arts, world history, United States history, politics, geography, anthropology, psychology, sociology, business, economics, science, health, technology and ethnic history and culture (e.g., American Indian, Afro-American, etc.).

U.S. Pat. No. 5,377,990, entitled "Board game incorporating native American symbols and knowledge" that issued to Seeney-Sullivan includes a board game in the general form of a circular pattern of native American symbols includes a matrix of like symbols in the center. Players toss a projectile at specific symbols in the board center, attempting to hit those symbols which match those along the periphery of the board which have been assigned to each player. Successful strikes are marked with an appropriate and distinctive marker. A player continues so long as he/she successfully hits the desired symbols, up to a maximum of six. The player is then randomly rewarded with symbol cards equal to the number of successful hits, which cards are turned face up.

Those that match are placed upon the player's peripheral symbols, indicating that those have been acquired by the player and need not be acquired again. Other players may claim the first player's non-matching cards if those cards match their symbols. Other players may also challenge the first player with questions which must be answered successfully before the first player can win the game.

U.S. Pat. No. 5,454,569, entitled "Afro American educational quiz game" that issued to Donald P. Walker includes an Afro American Educational Quiz Game where players receive points for correctly identifying notable black persons on question and answer cards. The game has a game board divided into multiple subject categories with letters for each category and numbers corresponding to letters and numbers on the question and answer cards and token chips, which are kept in a card box, having separate compartments for each subject matter and a chip box with separate compartments for each category. A person chosen as monitor places the numbered and lettered chips on the correspondingly matched numbered and lettered sections of the game board. A player then chooses a category. The monitor then selects a chip from the category chosen by the player, and the monitor picks the question and answer card corresponding to the number and letter on the selected chip. The question and answer card has a mini biography of a notable black person on one side and a photograph of the notable black person on the other side. The player who correctly identifies the notable black person accumulates points until all the cards are retired.

However, these inventions still do not solve all of the problems associated with providing board games related to African American culture.

It is desirable to provide board games related to African American culture, including, but not limited to, history, language including slang, music, movies, sitcoms, sports.

SUMMARY OF THE INVENTION

In accordance with preferred embodiments of the present invention, some of the problems associated with providing board games related to African American culture are overcome. An African American board game apparatus and method is presented.

The board game and apparatus game is specifically related to African American culture, including, but not limited to, history, language including slang, music, movies, sitcoms, sports. It includes an audio-visual device that allows audio snippets and video snippets and electronic text to be displayed for trivia questions for selected time periods (e.g., 1960's, 1970's, 1980's, 1990's, etc.) related to African American culture.

The foregoing and other features and advantages of preferred embodiments of the present invention will be more readily apparent from the following detailed description. The detailed description proceeds with references to the accompanying drawings.

BRIEF DESCRIPTION OF THE DRAWINGS

Preferred embodiments of the present invention are described with reference to the following drawings, wherein.

DETAILED DESCRIPTION OF THE INVENTON

Exemplary Board Game Apparatus

Figure 1A:
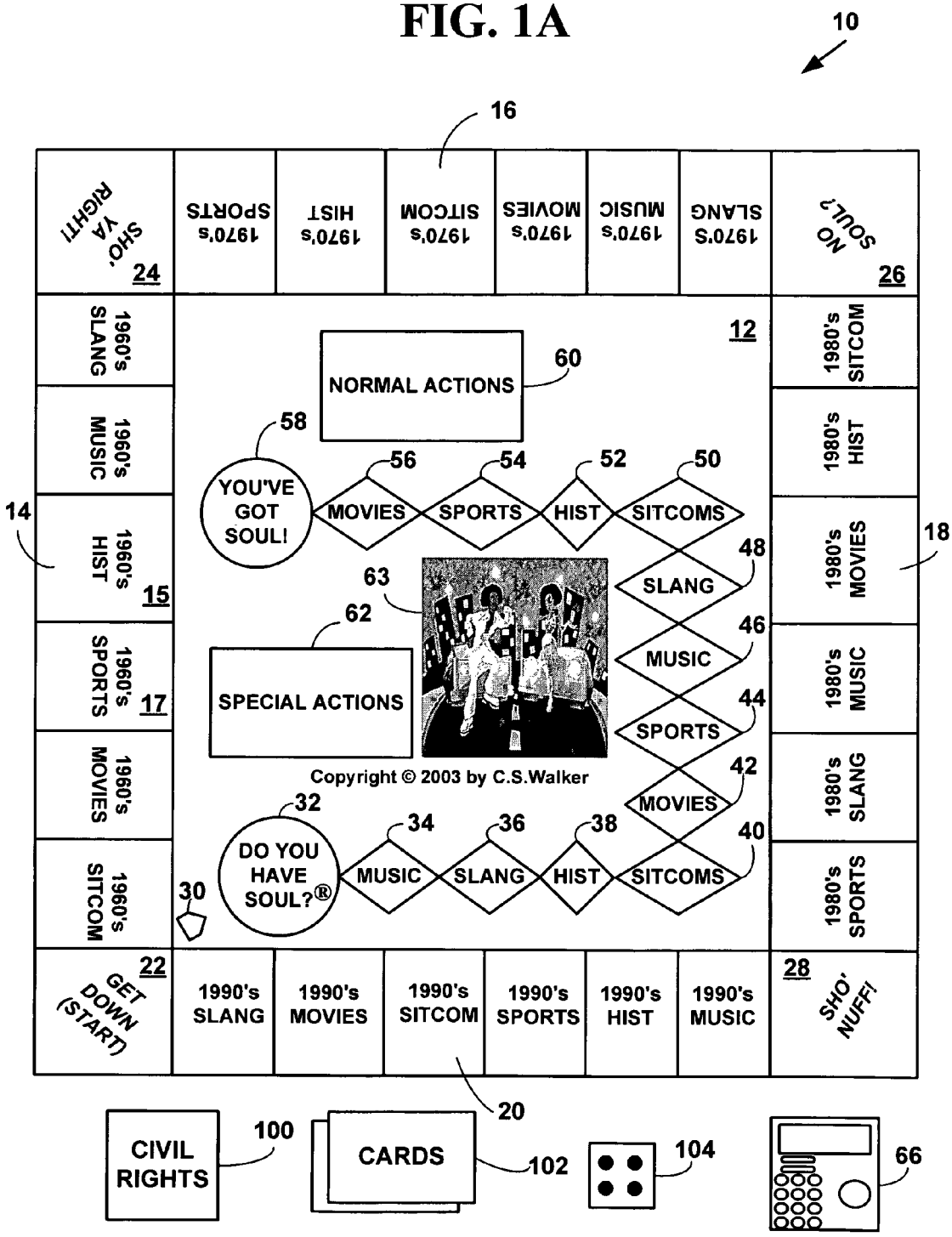
FIG. 1A is a block diagram illustrating an exemplary board game apparatus.

FIG. 1 is a block diagram illustrating an African American board game apparatus 10 (herein after board game apparatus for simplicity). The board game apparatus 10 includes a game board having a playing surface 12 divided into four playing sections 14, 16, 18, 20 further comprising plural rectangular shaped sections, four corner sections 22, 24, 26, 28, further comprising square shaped sections, and an end-of-game playing section 30 further comprising a first circular shaped section 32, plural diamond-shaped sections 34, 36, 38, 40, 42, 44, 46, 48, 50, 52, 54, 56 and a winner's section comprising a second circular shaped section 58. A subject category and a time period in each of the playing sections 14-20 is different and includes different orderings of the subject categories in each section. In addition, the subject category of the four corner sections 22-28 and the plural diamond-shaped sections 34-56 are different. However, the invention is not limited to such playing surface 12 layout described and other layouts with more or fewer sections can also be used to practice the invention.

Each of the four playing sections 14-20 and the end-of-game playing sections 34-56 comprises a subject category related to African American culture, including, but not limited to, history, language, including slang, movies, music, television and radio, sports, etc. and a time period, including, but not limited to, the 1960's, 1970's, 1980's and 1990's and beyond. The four playing sections 14-20 are sections in which normal game actions are initiated. The end-of-game playing sections 32-56 are sections in which end-of-game actions are initiated.

The four corner sections 22-28 are action sections from which special game actions are initiated. The circular shaped sections 32 and 58 are sections in which end-of-game bonus actions are initiated.

The board game apparatus 10 further includes plural location outlines 60, 62 two of which are illustrated to place plural sets of action playing cards in which normal game actions and end-of-game actions and special games actions are initiated.

The board game apparatus 10 further includes multi-color artwork 63, 65 related to the subject categories and time periods.

As is illustrated in FIG. 1A, a time period is selected for each playing section 14-20 (e.g., 1960's, 1970's, etc.) and the categories are alternated in the plural playing sections 14-20.

Figure 1B:
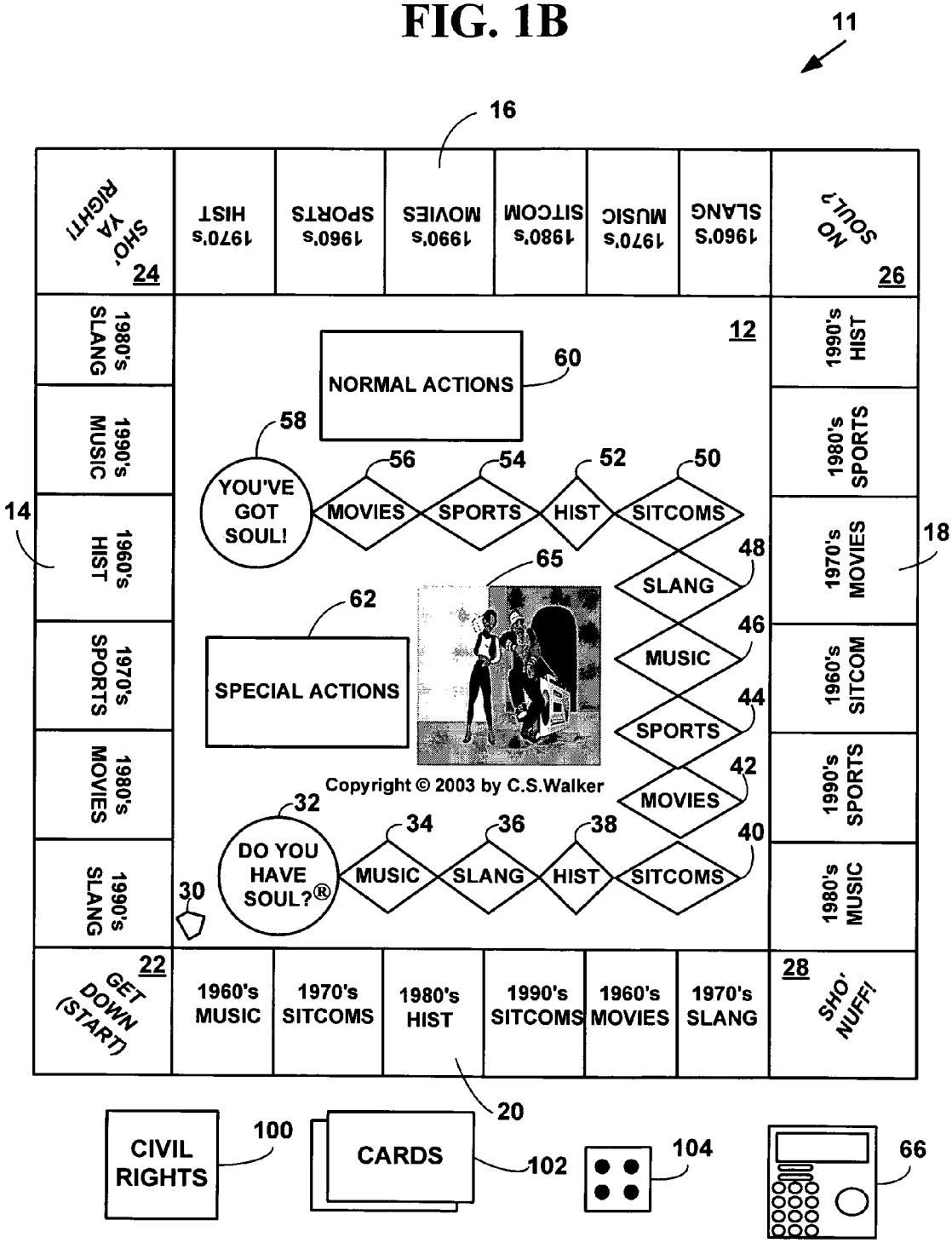
FIG. 1B is a block diagram illustrating another exemplary board game apparatus.

FIG. 1B is a block diagram 11 illustrating another exemplary board game apparatus. In this embodiment, both the time period and the categories are randomly alternated in each of the plural playing sections 14-20.

However, the invention is not limited to these embodiments and other combinations of dates and categories on the plural playing sections can also be used to practice the invention.

Figure 2:
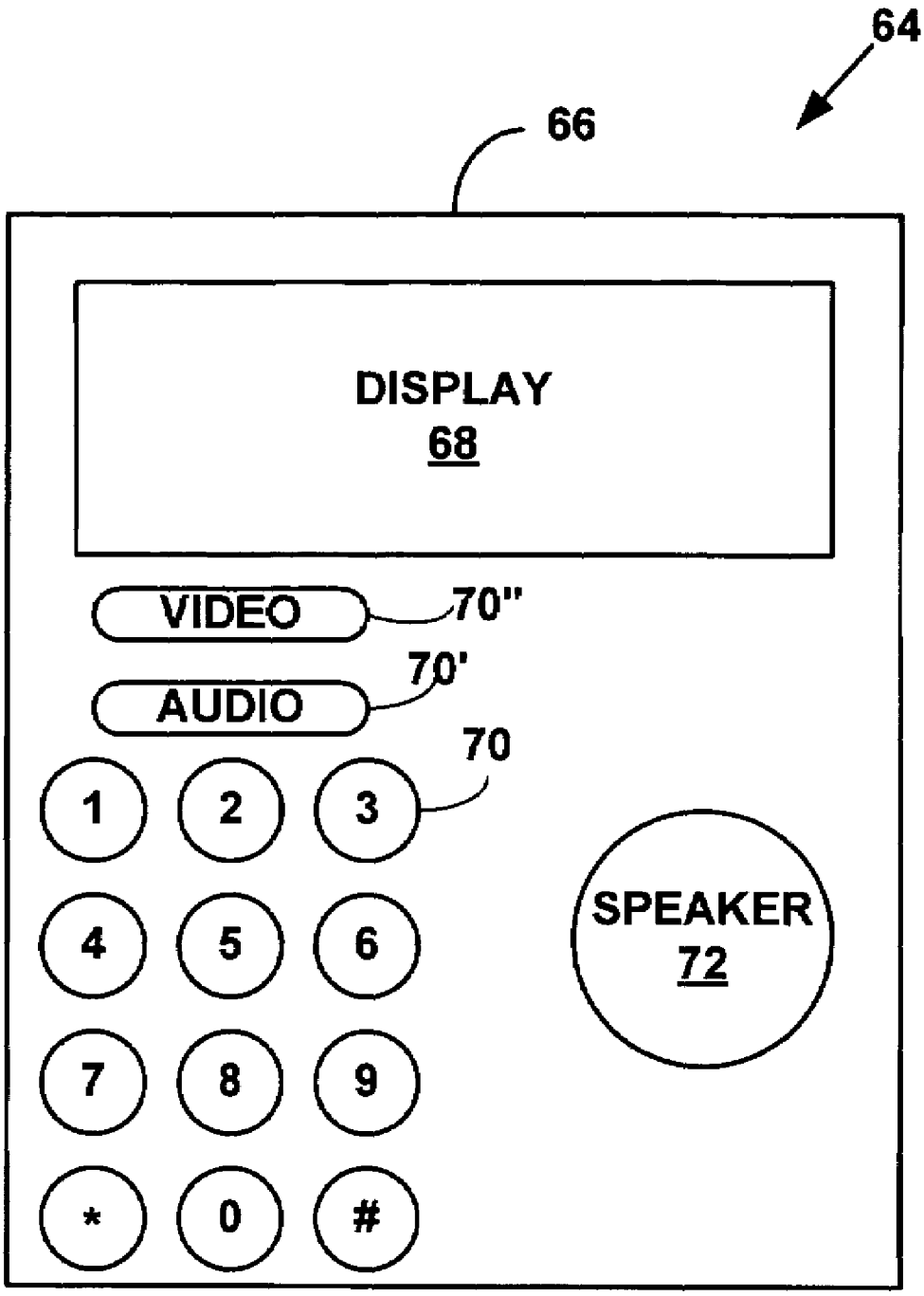
FIG. 2 is a block diagram illustrating details of an audio-visual apparatus for the board game of FIG. 1.

FIG. 2 is a block diagram 64 illustrating details of an audio-visual apparatus 66 for the board game of FIG. 1. The board game apparatus 10 further includes an audio-visual device 66 comprising a display 68, an alpha numeric key-pad 70 (illustrated as numeric only for simplicity) and a speaker 72. In one embodiment, the alpha number key-pad 70 includes specialized buttons for selecting audio 70' and video 70" snippets to be played on the display 68. A snippet is a short (e.g., 10-60 second) audio or video clip. In another embodiment, the alpha-numeric key pad 70 does not include any specialized buttons and audio and video snippets are selected using numbers or numeric codes entered via the alpha-numeric key pad 70.

The audio-visual device 66 further comprises an ornamental cover 74 comprising an object from African American culture in which the display 68, alpha-number key-pad 70 and speaker 72 are ornamentally integrated. In one embodiment, the ornamental cover 74 includes a colored plastic cover comprising a square, rectangle, polygon or other standard shape. However, the ornamental cover 74 is not limited to such an embodiment and can include covers made from other materials such as cardboard or paper printed with an African American culture object, plastic, rubber, such as a rubberized membrane, composite, metal, wood or other materials.

The ornamental cover 74 can be used to cover a standard rectangular or square-shaped audio-visual devices 66. This allows a standard size and shaped audio-visual device to be produced, yet makes the game components more visually appealing and makes the game more fun to play.

In another embodiment of the invention, the audio-visual device 66 is made directly in an irregular shape of an object from African American culture. In such an embodiment, the display 68, alpha-numeric key pad 70 and speaker 72 are ornamentally integrated directly into the design of the African American culture object (e.g., directly into colored plastic). In one embodiment, the ornamental cover 74 includes a profile of a non-historical, historical or a fictional African American person.

Figure 3:
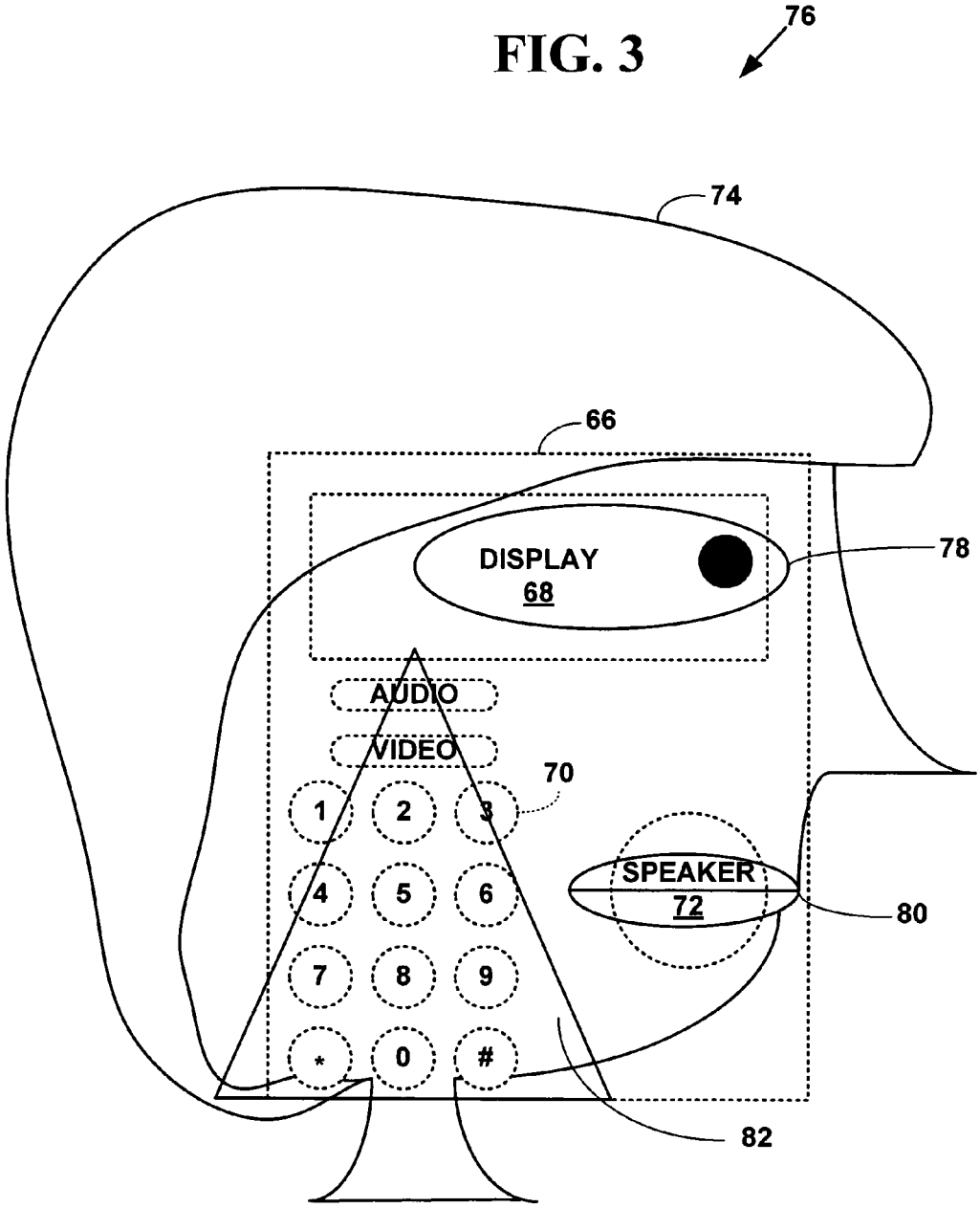
FIG. 3 is a block diagram illustrating an exemplary ornamental cover for the audio-visual apparatus of FIG. 2.

FIG. 3 is a block diagram 76 illustrating an exemplary ornamental cover 74 for the audio-visual apparatus 66 of FIG. 2. For example, the ornamental cover 74 can include, but is not limited to, an African American male profile from the 1970's decade including an African American "Fro" hair style, and large triangular side-burns, a grooming style popular with men in the 1970's. In such an embodiment, openings for an eye-section 78 overlays the display 68, a side-burn section 80 selectively overlays the alpha-numeric keypad 70 and a mouth section 82 overlays the speaker 72. However, FIG. 3 is illustrative only and other ornamental covers with other openings or no openings (e.g., replaced by decorative features) can be used to practice the invention.

The ornamental cover 74 includes attachment means (not illustrated) for clipping to or sliding over the audio-visual apparatus 66. However, the present invention is not limited to such an embodiment and other ornamental objects from African American culture can also be used for the ornamental cover 70 of the audio-visual device.

The audio-visual device 66 includes plural buttons on an alpha-numeric keypad for selecting a category (e.g., slang, movies, music, television and radio, sports) and a time period (e.g., 1960's, 1970's, 1980's, 1990's and beyond, etc.) and for entering numeric codes obtained from cards used for the game and to input answers to questions displayed.

The displays 68 includes a monochrome liquid crystal display, color display other display that displays both alpha-numeric text and graphical images and video. The speaker 72 is used for displaying audio snippets and sound tracks from video snippets store on the audio-visual device 66.

Figure 4:
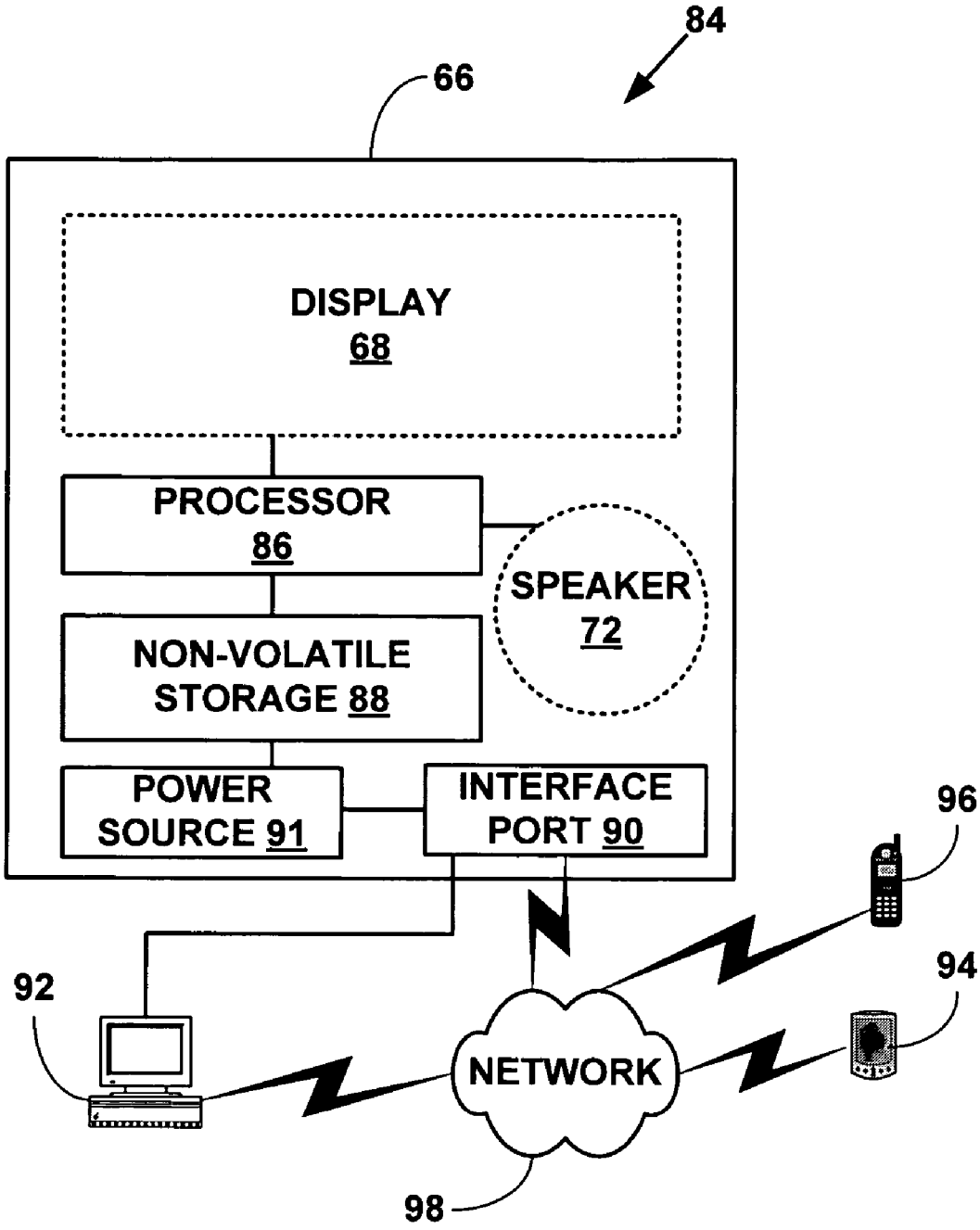
FIG. 4 is a block diagram illustrating further internal details of the audio-visual apparatus of FIG. 2.

FIG. 4 is a block diagram 84 illustrating further internal details of the audio-visual apparatus 66. The audio-visual device 66 includes, but is not limited to, a processor 86, non-volatile storage 88 including, but not limited to a read-only-memory ("ROM") chip, flash memory chip, or other non-volatile storage (e.g., hard drive, etc.) that is used to store digital audio snippets (e.g., in WMA, MP3, OGG, VQF, WAV, MIDI, etc.) and digital video snippets (e.g., MPEG, Quick-time, Realvideo, AVI, WMV, DVD, etc.), one or more interface ports 90, and a power source 91. The audio-visual device 66 may also include volatile storage in combination with the non-volatile storage 88 such random access memory ("RAM"). The audio-visual device 66 may also include other external non-volatile storage such as a CD-ROM, hard drive, floppy drive, etc. (not illustrated).

The power source 91 includes a direct current ("DC") power source from batteries and/or an alternating current ("AC") power source.

In one embodiment, the audio-visual device 66 includes only non-volatile storage 88. In another embodiment, the audio-visual device includes only volatile storage. In another embodiment, the audio-visual device includes a combination thereof of non-volatile storage 88 and volatile storage.

The non-volatile storage 88 includes a flash ship or ROM chip that is removable and can be replaced with upgrades or additional game topics. The flash memory chip is reprogrammable and can be re-programmed via the interface port 90 from a user's computer 92, the external CD-ROM, or other wireless or wired network devices such as a personal digital assistant 94, mobile phone 96 or other network device via a communications network 98 such as the Internet, an intranet, or other wired (e.g., Public Switched Telephone Network ("PSTN") Cable Television ("CATV")) or wireless network.

In one embodiment, the audio-visual device 66 can be connected via the interface port 90 to a computer 92 or television (not illustrated) to display electronic text, audio and video information on the computer 92 or television displays.

In another embodiment, question and answer data can be stored on an external CD-ROM or DVD and accessed through the interface port 90. Such an embodiment provides storage space to store more complex question and answer data and longer audio and video snippets (e.g., multiple minutes in length).

In another embodiment, question and answer data can be stored on one or more servers on the communications network 98. Such an embodiment provides storage space to store more complex question and answer data and longer audio and video snippets. In such an embodiment, new or additional question and answer data could be directly obtained or randomly obtained each time the audio-visual device 66 accessed the network 98. In such and embodiment, question and answer data might not be stored in the audio-visual device 66 at all and the non-volatile storage 88 may be total replaced by volatile storage (e.g., RAM) that is used to temporarily store and display the question and answer data in the audio-visual device 66 as long as the audio-visual device is powered on.

In one embodiment of the present invention, the non-volatile storage 88 includes game data selected by four-digit numeric codes. This allows up to one-thousand different questions to be provided via the audio-visual device 66. However, the present invention is not limited to four-digit numeric codes and larger or smaller numeric codes can also be used.

In one embodiment of the present invention, the four-digit numeric codes are grouped by subject categories. For example, the numeric codes from 0000-0999 are used for history, 1000-1999 are used for movies, 2000-2999, etc. However, the present invention is not limited to this embodiment and the questions can also be group by time-period or in other ways.

An operating environment for the audio-visual device 66 includes a processing system with one or more high speed Central Processing Unit(s) ("CPU"), processors and one or more memories. In accordance with the practices of persons skilled in the art of computer programming, the present invention is described below with reference to acts and symbolic representations of operations or instructions that are performed by the processing system, unless indicated otherwise. Such acts and operations or instructions are referred to as being "computer-executed," "CPU-executed," or "processor-executed."

It will be appreciated that acts and symbolically represented operations or instructions include the manipulation of electrical signals by the CPU or processor. An electrical system represents data bits which cause a resulting transformation or reduction of the electrical signals, and the maintenance of data bits at memory locations in a memory system to thereby reconfigure or otherwise alter the CPU's or processor's operation, as well as other processing of signals. The memory locations where data bits are maintained are physical locations that have particular electrical, magnetic, optical, or organic properties corresponding to the data bits.

The data bits may also be maintained on a computer readable medium including magnetic disks, optical disks, organic memory, and any other volatile (e.g., RAM) or non-volatile (e.g., ROM, flash memory, etc.) mass storage system readable by the CPU. The computer readable medium includes cooperating or interconnected computer readable medium, which exist exclusively on the processing system or can be distributed among multiple interconnected processing systems that may be local or remote to the processing system.

Returning to FIG. 1, the a board game apparatus 10 further includes plural game playing pieces 100 (one illustrated) including ornamental objects from African American culture including ornamental objects from the categories and time periods discussed above.

For example, the plural games pieces may include, a replica of a CD-ROM with an African-American artist printed thereon indicative of the 1990's, rap concert poster with an African-American artist printed thereon or boom box indicative of the 1980's, an eight-track tape or cassette tape with an African-American artist printed thereon, a hat, etc. indicative of the 1970's, a replica of an African American hair pick, etc., a civil rights poster for a march indicative of the 1960's, etc. However, the invention is not limited to such an embodiment, and virtually any object from African American culture during the time periods discussed can be used. The plural game playing 100 are made from a variety of materials include, colored plastic, metal, paper, cardboard, rubber, composite or other materials.

The board game apparatus 10 of FIG. 1 further includes at least two decks of playing cards 102 used to play the game. The playing cards 102 are placed on the game board 12 at locations 60 and 62. The board game apparatus 10 of FIG. 1 further includes one or more dice 104 used to play the game.

However, the present invention is not limited to the board game apparatus 10 components described and more, fewer or other components can also be used to practice the invention.

Exemplary Board Game Method

Figure 5:
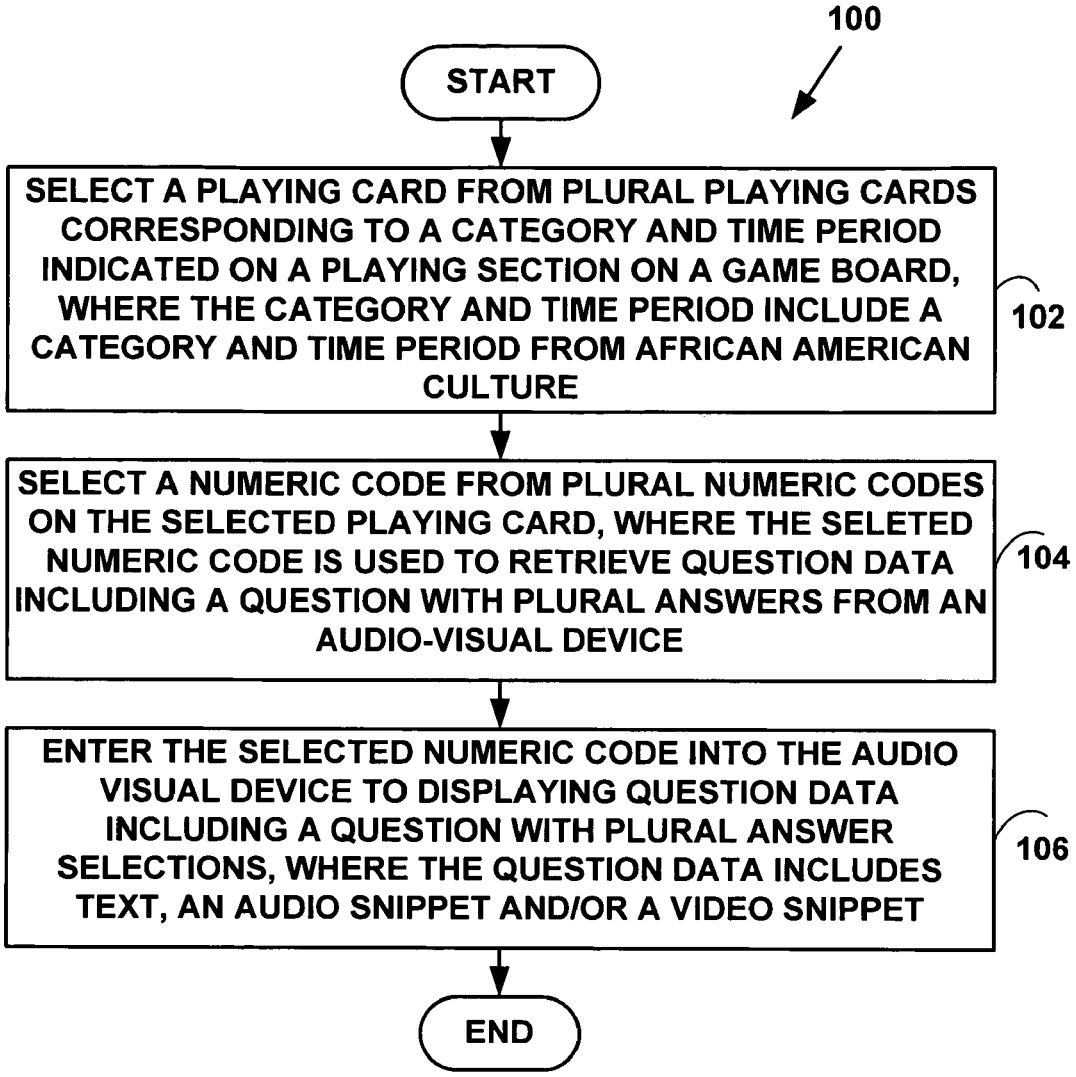
FIG. 5 is a flow diagram illustrating a method for playing a board game.

FIG. 5 is a block diagram illustrating a Method 100 for playing a board game. At Step 102, a playing card is selected from plural playing cards 102 corresponding to a subject category and a time period indicated on a playing section (e.g. 15, 17) on a game board 10. The subject category and time period include a subject category and time period from African American Culture. At Step 104, a numeric code (e.g., 118) is selected from plural numeric codes on the selected playing card where the numeric code is used to retrieve question and answer data from an audio-visual device 66. At Step 106, the selected numeric code 118 is entered into the audio visual device 66 for displaying the question data including a question with plural answer selections from the audio-visual device 66. The question includes electronic text, an audio snippet and/or a video snippet.

Figure 6:
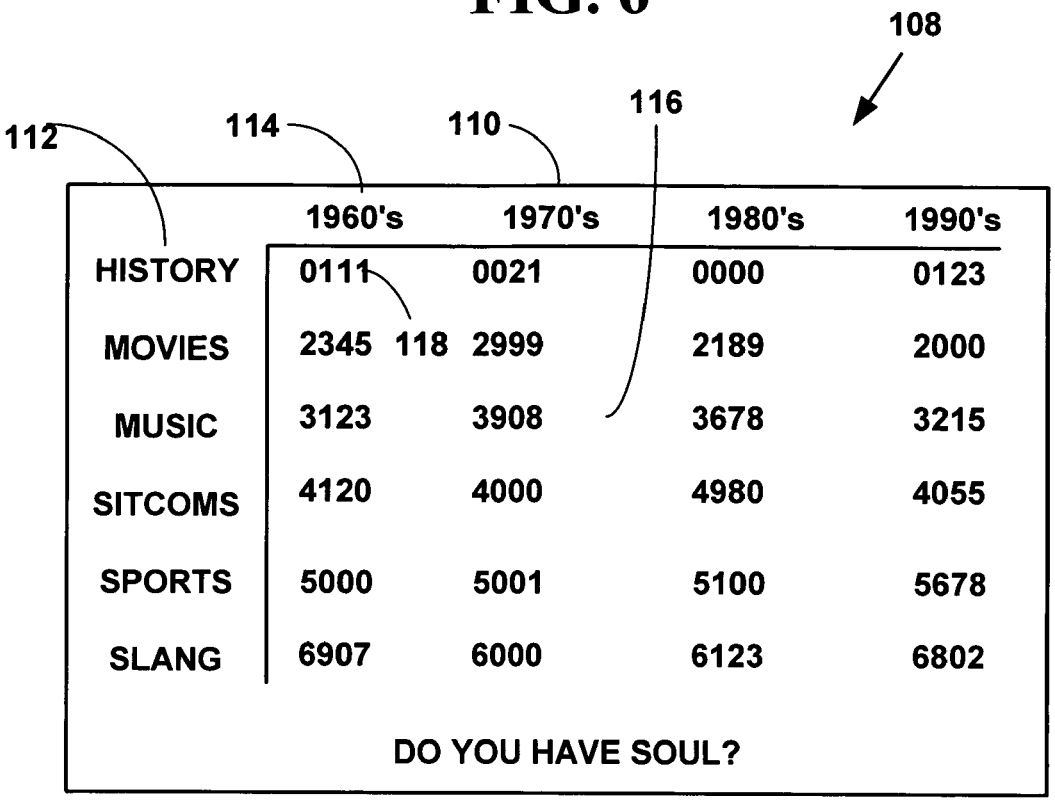
FIG. 6 is a block diagram illustrating an exemplary playing card for normal game actions.

FIG. 6 is a block diagram 108 illustrating an exemplary playing card 110 for normal game actions. The exemplary playing card 110 includes a list of plural subject categories 112 and a list of plural time periods 114 for the subject categories and plural game numeric codes 116 that used to enter into the audio-visual device 66 to display the corresponding questions.

FIG. 6 illustrates the list of subject categories in a column and the list of time periods 114 in rows and the plural numeric codes 116 at intersections of the row and columns. However, the present invention is not limited to this embodiment and other layouts can also be used to practice the invention.

For example, if a user rolled a four using one dice 104 using the game board 12 from FIG. 1A, the user would end up in a playing section 15 labeled "1960's History." The user would pick a card from a playing card deck 102 placed at location 60 for normal operations of the game. The user would then find the numeric code at the intersection of the time period "1960's" and the subject category "History," or retrieve numeric code 0111 (item 118 of FIG. 6). This numeric code is entered in the audio-visual device 66 via the alpha-numeric keypad 70. The audio-visual device 66 will return question data comprising a question with plural answer selections displayed via the display 68 and/or the speaker 72.

For example, the numeric code 0111 may return question data comprising only electronic text illustrated by the (TEXT ONLY) moniker including a question with plural answers, such as the exemplary question illustrated in Table 1.

TABLE 1

| |
|---|
| 1960's African American History: |
| (TEXT ONLY) |
| Who delivered the "I Have Dream Speech" on the steps of the Lincoln Memorial in Washington D.C. on Aug. 28, 1963? |
| 1. Ms. Rosa Parks. |
| 2. Rev. Jesse Jackson. |
| 3. Malcolm X. |

TABLE 1-continued

| |
|---|
| 4. Dr. Martin Luther King, Jr. |
| Input 1-4. |
| (Correct Answer in this example is 4). |

The numeric code 0111 may also return question data comprising audio along with the electronic text question illustrated in Table 1 such as a 10 second audio or snippet of Dr. King saying "I have a dream today" which is played through the speaker 72 on the audio-visual device 66.

In one embodiment of the present invention, the user may repeat the audio snippet by pressing the audio button 70'. In another embodiment of the present invention, the user may repeat the audio snippet by re-entering the numeric code 0111. In either embodiment, the question illustrated in Table 1 remains on the display 68 when the audio snippet is replayed.

The numeric code may also return question data question data comprising a video snippet along with the question illustrated in Table 1, such as a thirty-second video snippet of Dr. King saying "I have a dream that one day this nation will rise up and live out the true meaning of its creed: "We hold these truths to be self-evident: that all men are created equal" displayed via the display 68 and the speaker 72. After displaying the video snippet, the question in Table 1 would be displayed on the display 68.

In one embodiment of the present invention, the user may repeat the video snippet by pressing the video button 70". In another embodiment of the present invention, the user may repeat the video snippet by re-entering the numeric code 0111. In both embodiments, the question illustrated in Table 1 is removed, the video snippet is re-played, and the question is restored. In another embodiment, the display 68 is split into two or more portions so the question illustrated in Table 1 is displayed on a first portion of the display 68 and the video snippet is simultaneously displayed on a second portion of the display 68.

In another embodiment, the user may select a next question for a subject category and time period by pressing a special key (e.g., "*" key or "#") on the key-pad 70 instead of using playing cards 102. In such an embodiment, question and answer data would be displayed in the form of electronic text information on the display 68.

In any of the embodiments described, if the user could not answer the question reading the electronic text information, the user may then press the audio key 70' or the video key 70" to obtain additional clues to answer the question. In such an embodiment, if the user pressed the audio key 70', the clue would be displayed through the speaker 72. If the user pressed the video key 70", the video clue would be displayed on the display 68 (with or without the corresponding electronic text information).

The user uses the keypad 70 on the audio-visual device 66 to select the correct answer (e.g., press the number four key for the question in Table 1). The audio-visual device 66 will respond with a electronic text including CORRECT or INCORRECT response or a video snippet including a CORRECT or INCORRECT response on the display 68 or via an audio voice response saying the words CORRECT OR INCORRECT or audio tone response (e.g., a recognizable beep or tone or series of tones or beeps) via the speaker 72.

In another embodiment, a user may obtain a numeric code retrieved from a playing card 102 and then use the numeric code to obtain second numeric code from a table of codes. The second numeric code is then entered into the audio-visual device 66. In another embodiment, a user may obtain a numeric code directly from the game board playing surface 12 that corresponds to a subject category and time period from one of the plural playing sections (e.g., 15, 17). This numeric code is also entered into the audio-visual device.

In another embodiment of the invention, the playing cards 102 include questions and plural answer selections, such as the question illustrated in Table 1, directly on the cards. The correct answer to the question is also printed on the card (e.g., upside down, on the back, etc.). In such an embodiment, there are deck of playing cards 102 corresponding to each subject category (e.g., African American history, movies, music, etc.) with time-periods (1960's-1990's) and corresponding numeric codes listed.

Figure 7:
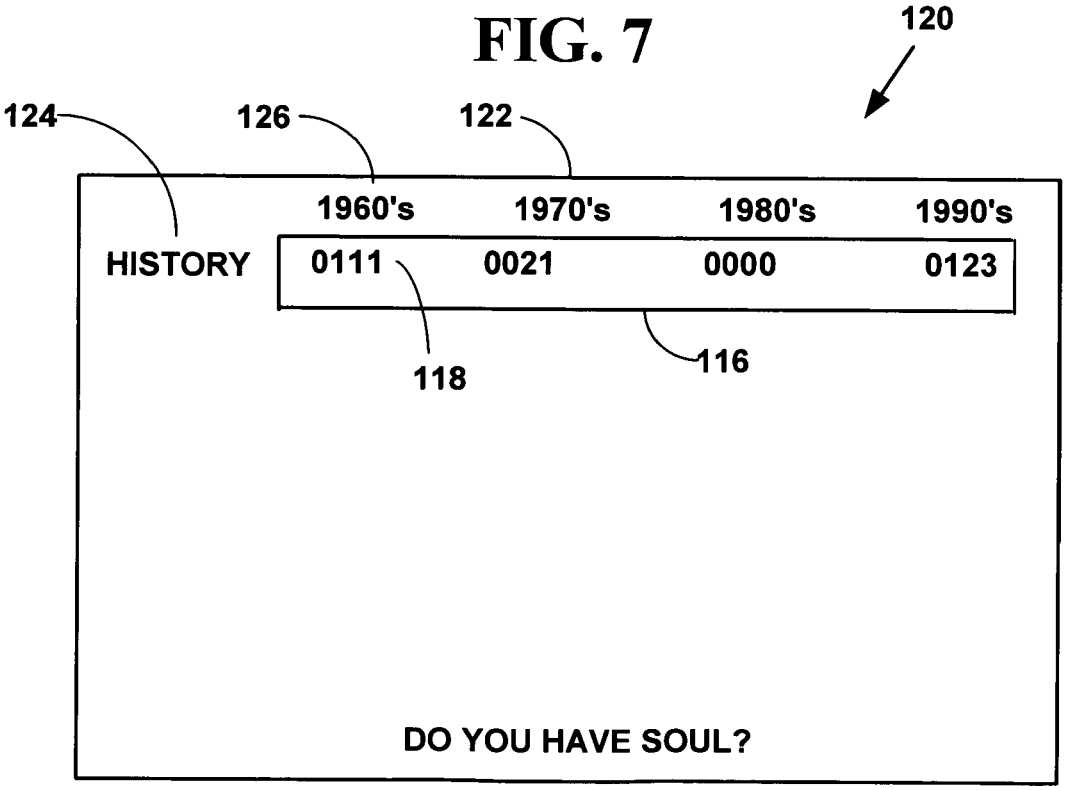
FIG. 7 is a block diagram illustrating another exemplary playing card for normal game actions.

FIG. 7 is a block diagram 120 illustrating another exemplary playing card 122 for normal game actions. The exemplary playing card 120 includes only one subject category 124 (e.g., history) and plural time periods 126 for the categories and plural game codes 116 that used to enter into the audio-visual device 66 to display questions for the category. In another embodiment, the exemplary playing cards 102 may include plural subject categories 124 and one time period 126 (e.g., 1960's). There are other various combinations that can also be used to practice the invention on the playing cards 102.

In another embodiment of the invention, the cards 102 include a mix of both the exemplary playing card 110 illustrated in FIG. 5 and cards, such as those illustrated in Table 1, with questions and answer selections and answers, directly printed thereon.

In another embodiment of the invention, the cards 102 include a mix of both the exemplary playing card 110 illustrated in FIG. 5 and FIG. 7 and cards, such as those illustrated in Table 1, with questions and answer selections directly printed thereon.

Various combinations and types of cards can be used. For example, in one embodiment of the invention, only the music category includes audio snippets and only the movies category includes video snippets. Thus, the cards 102 for the music and movie categories would include cards similar to that illustrated in FIG. 7. In such an embodiment, the questions and answer selections and answers for the remaining categories would be printed directly on cards 102 in a format such as is illustrated in Table 1. Such an embodiment may include three decks of cards for normal actions, one for the music category, one for the movie category and one for the remaining categories. Such an embodiment may also include two decks of cards for normal actions, one for the music and movie categories similar to that illustrated in FIG. 6 (but modified to include two categories) and one for the remaining categories.

However, the invention, is not limited to these embodiments, and other embodiments and other combinations of cards, and more, fewer or other types of cards, with and without numeric codes usable by the audio-visual device can also be used to practice the invention.

Figure 8:
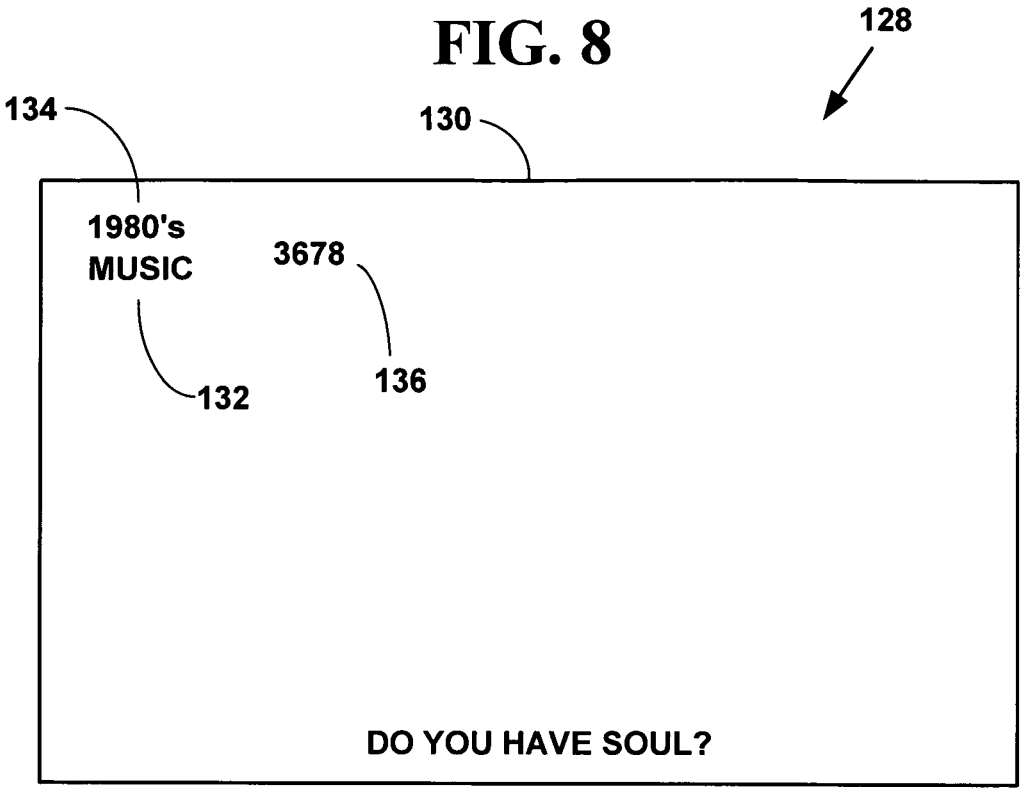
FIG. 8 is a block diagram illustrating an exemplary playing card for end-of-game actions.

FIG. 8 is a block diagram 128 illustrating an exemplary playing card 130 for end-of-game actions. This card 130 and similar cards are used for end-of-game actions when a player reaches the diamond playing sections 34-56. The card 130 includes a category 132 (e.g., music) and a time period 134 (1980's) and a corresponding numeric code 136 (e.g., 3678) that obtained directly (i.e., not from an intersection of a row and a column).

For example, a player would start in the first circular playing section 32 (e.g., DO YOU HAVE SOUL?®, and then advance to the music diamond playing section 34. The player when then select an end-of-game action card 130 such as the exemplary card illustrated in FIG. 8. The player would learn he/she has a "1980's music topic" and enter its corresponding numeric code 3768 into the audio visual device to obtain the question data and question related to 1980's music. Similar cards are available for the remaining categories and are spread across multiple time periods to cover the various combinations of categories and time periods.

Figure 9:
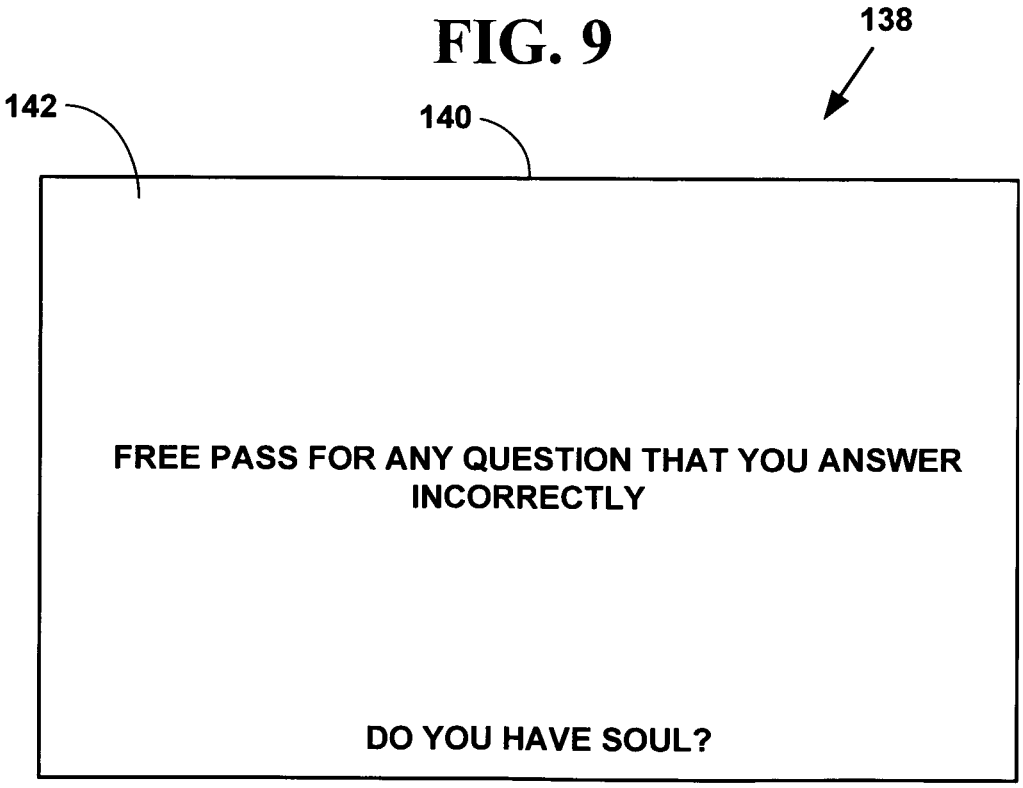
FIG. 9 is a block diagram illustrating another exemplary playing card for special actions.

FIG. 9 is a block diagram 138 illustrating an exemplary playing card 140 for special actions. This card 140 and similar cards are used for special actions when a player reaches the square playing sections 24 and 28 (e.g., the SHO' YA RIGHT! and the SHO' NUFF! Squares). The card 140 and other similar cards include a special action (e.g., free pass for any question that you answer correctly, advance 3 squares, advance to the next history category playing section, ask another player to answer you question, etc.).

The board game apparatus 10 includes plural rules to play. Tables 2-4 illustrate a few exemplary rules. However, the present invention is not limited to such an embodiment and more, fewer or different rules can also be used. Table 2 illustrates a first exemplary rule.

TABLE 2

| |
|---|
| Players will role one die to start the game. The player who rolls the highest number is first. Players will go around the game board 12 a selected number of time in order to win the game (e.g., once, twice, etc.). On the final trip around the game board, from the start square 22, the players will enter the first circular-shaped section 32 and then the diamond shaped sections 34-56. In the diamond shaped sections 34-56, the die is no longer used and the player must answer a question from a diamond shaped section in order to advance to the next diamond shaped section. One player ends up in the second circular shaped section 58 as the winner of the game. |

Table 3 illustrates a second exemplary rule.

TABLE 3

| |
|---|
| A player gets three chances to answer a one question correctly for the category and time period. For example, if the player answers incorrectly, he/she picks another card and obtains another numeric code and then enters the numeric code into the audio-visual device 66 to obtain a second question. The process is repeated for a third question. If the player does not answer a question correctly after three chances, he/she goes to the "NO SOUL?" corner 24. This happens both when a playing is in a normal playing section 14, 16, 18, 20 and when a player is in the end-of-game playing sections 32-56. A player must roll a six on the dice to leave the NO SOUL? corner 26. During normal play, a player leaves the NO SOUL? corner 26 and continues. During end-of-game play, a player leaves the NO SOUL? corner 26 and re-enters the end-of-game-section at 30 from the start square 22 after answering enough questions to make it to the start square 22. |

Table 4 illustrates a third exemplary rule.

TABLE 4

| |
|---|
| If a player desires not to answer a question for a specific category and time period, he/she may move to the next available playing space by electing to pass on a question. In such a scenario, the player must then answer two questions in the next available playing space. For example, if a player does not like sports such as 1960's sports 17 (FIG. 1A), he/she may pass to the next available playing space such as 1960's History 15 and then answer two questions about 1960's history. |

Figure 10:
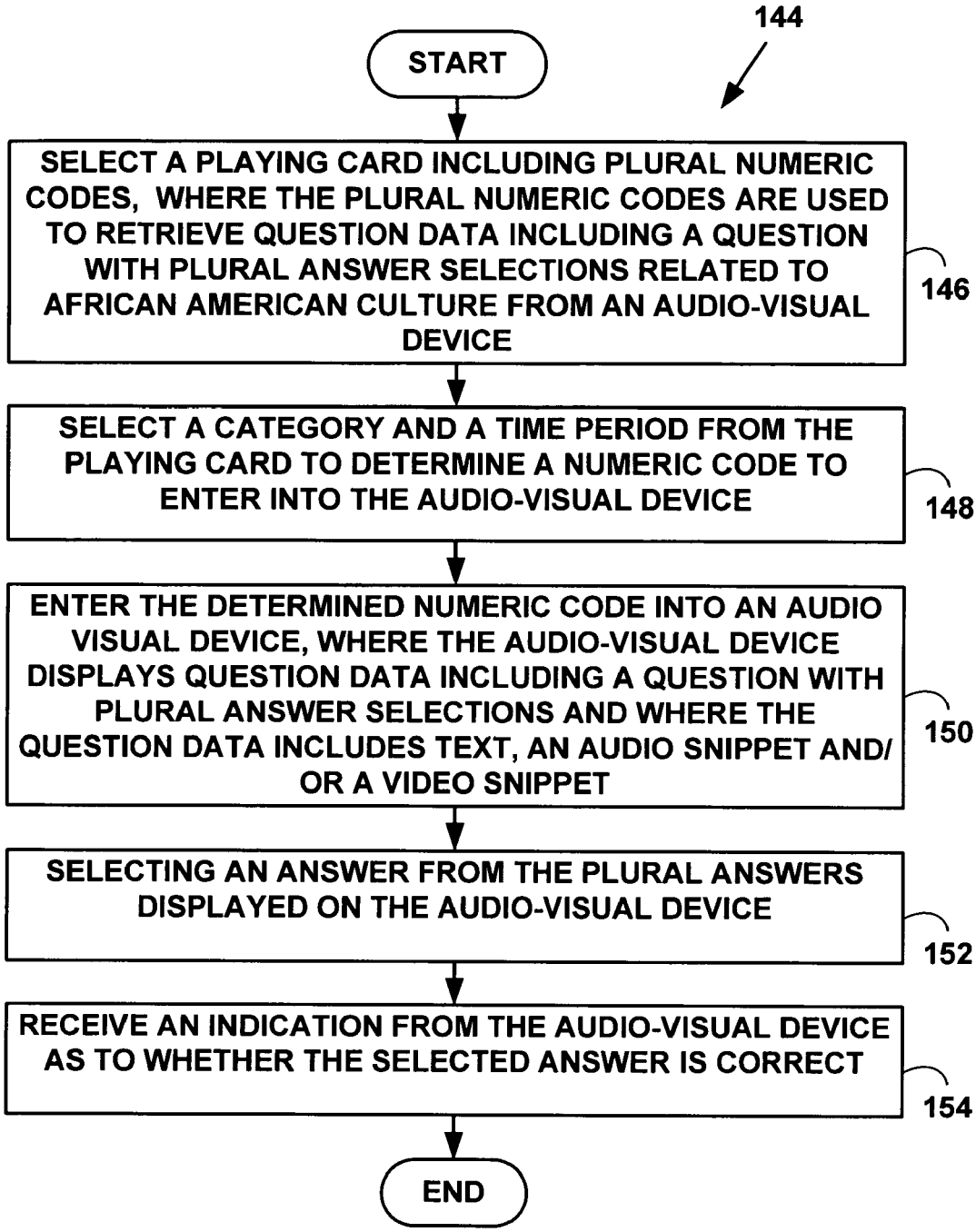
FIG. 10 is a flow diagram illustrating a method for playing a board game.

FIG. 10 is a flow diagram illustrating a Method 144 for playing a board game. At Step 146, a playing card including plural numeric codes is selected from a deck including plural playing cards. The plural codes numeric codes are used to retrieve question and answer data including a question with plural answer selections related to African American culture from an audio-visual device 66. At Step 148, a category and a time period is selected from the playing card and a numeric code is selected to enter into the audio-visual device 66. At Step 150, the selected numeric code is entered into the audio-visual device 66. The audio-visual device 66 displays the question and answer data including a question with plural answer selections on the display 68 and/or speaker 72. The question and answer data includes electronic text, an audio snippet and/or a video snippet as was described above. At Step 152, an answer is selected from the plural answers displayed on the audio-visual device 66. At Step 154 an indication of whether the selected answer is correct is received from the audio-visual device 66 as was described above.

The board game apparatus and method is described specifically for African American culture. However, the board game apparatus and method is not limited to African American culture and can be used for other racial/ethnic groups (e.g., Hispanic American, Native American, Irish American, Russian American, etc.). In such embodiment, the audio-visual device 66 would include questions, audio snippets and video snippets specifically for such racial/ethnic groups.

New ROM chips can be included in the audio-visual device 66, or the flash memory could be re-programmed via the interface port 90. In addition, the ornamental overlay 74 is created to represent a relevant symbol from a selected racial/ethnic group (e.g., for Native Americans, the ornamental cover 74 may include a profile of a Native American Chief with headdress, teepee, tomahawk, etc.). In such embodiments, the text of the four corner squares 22, 24, 26, 28, the circular playing sections 32, 58, the text on the cards 102 for normal and special actions and the game pieces 104 may also be modified to reflect the specific culture of the racial/ethnic group selected.

It should be understood that the programs, processes, methods and system described herein are not related or limited to any particular type of computer or network system (hardware or software), unless indicated otherwise. Various combinations of general purpose, specialized or equivalent computer components including hardware, software, and firmware and combinations thereof may be used with or perform operations in accordance with the teachings described herein.

In view of the wide variety of embodiments to which the principles of the present invention can be applied, it should be understood that the illustrated embodiments are exemplary only, and should not be taken as limiting the scope of the present invention. For example, the steps of the flow diagrams may be taken in sequences other than those described, and more fewer or equivalent elements may be used in the block diagrams.

The claims should not be read as limited to the described order or elements unless stated to that effect. In addition, use of the term "means" in any claim is intended to invoke 35 U.S.C. §112, paragraph 6, and any claim without the word "means" is not so intended.

Therefore, all embodiments that come within the scope and spirit of the following claims and equivalents thereto are claimed as the invention.

We claim:

1. An African American board game system, comprising in combination:

a game board having a playing surface divided into a plurality of sections and four corner sections, wherein the plurality of sections are divided into a plurality of sub-sections, each sub-section comprising a subject category related to an African American cultural time period for the subject category, and wherein the African American cultural time period for each of the sub-sections in a section on the game board lists a decade from the African American cultural time period;

a plurality of playing cards including a subject category related to African American culture and a time period for the subject category, wherein the plurality of playing cards include a plurality of numeric codes used to retrieve question and answer data from a hand held audio-visual apparatus included with the game board;

a plurality of game pieces for keeping a location position on the game board including ornamental objects from African American culture related to the subject category and time period for indicating a position on one of the plurality of sections on the game board;

a hand held audio-visual apparatus comprising an integral display, an alpha numeric key-pad, a speaker, a processor, one or more interface ports, a power source and non-volatile storage for storing audio, video and electronic textual information for question and answer data including the subject categories and the time periods related to African American culture and non-volatile storage for storing the plurality of numeric codes, wherein a selected numeric code manually entered into the hand held audio video apparatus is used to retrieve question and answer data from the non-volatile storage corresponding to the numeric code, wherein the plurality of numeric codes includes a plurality of four-digit numeric codes grouped by the subject categories and the time periods for the subject categories, wherein the hand held audio-visual apparatus includes separate specialized buttons one specifically for selecting audio snippets and one specifically for selecting video snippets to be played, wherein the specialized buttons are also used for repeating an audio snippet or video snippet after it has been played and used for providing additional audio clues or visual clues for retrieved question and answer data when the specialized buttons are pushed additional times, wherein new or additional question and answer data and more complex question and answer data are stored on one or more external servers on a communications network, wherein the complex question and answer data includes and longer audio and video snippets to large to be stored in the original non-volatile storage, wherein the one or more external servers on the communications network are accessed on the hand held audio-visual device via the one or more interface ports during name play thereby providing new or additional question and answer data and more complex question and answer data that did not exist at a time the non-volatile storage was created or was too large to be stored in the non-volatile storage on the hand held audio-visual device, wherein new or additional question and answer data and the more complex questions and answer data is obtained either directly or randomly from the one or more external servers instead of from the non-volatile storage during name play and wherein the non-volatile storage can be re-programmed with new or additional question and answer data or more complex question and answer data via the interface port.

2. The African American board game system of claim 1 wherein the a plurality of playing cards include subject categories and time periods in a plurality of rows and columns and wherein the plurality of numeric codes are placed at a plurality of intersections of the plurality of rows and columns and wherein the plurality of numeric codes are used to retrieve a desired question and answer related to a selected subject category and time period from African American culture from non-volatile storage on the hand held audio-visual apparatus.

3. The African American board game of claim 1 wherein the subject category includes history, language, including slang, movies, music, television and radio or sports from African American culture.

4. African American board game system of claim 1 wherein the plurality of numeric codes are manually entered via the alpha numeric key-pad on the audio-visual apparatus to retrieve question and answer data that is displayed on the display or on the speaker.

5. The African American board game system of claim 1 wherein the question and answer data includes electronic text and audio or video information related to the question and answer data.

6. The African American board game system of claim 1 wherein the plurality of game pieces include a replica of rap poster, boom box, an eight-track tape, a cassette tape, a civil rights poster, a hair pick or a hat from African American culture.

7. The African American board game system of claim 1 wherein the wherein the non-volatile storage of audio-visual apparatus includes a flash memory chip.

8. The African American board game system of claim 6 wherein the flash memory chip is programmable via the interface port.

9. The African American board game system of claim 1 wherein the audio-visual apparatus includes an ornamental cover in a shape of an object from African-American culture with portions of the ornamental cover selectively placed over the display, key-pad and speaker of the audio-visual apparatus.

10. The African American board game system of claim 9 wherein the ornamental cover includes a cardboard, paper, plastic, rubber, composite, metal or wood ornamental cover.

11. The African American board game system of claim 9 wherein the ornamental cover includes a profile of a non-historical, historical or a fictional African American person.

12. A method for playing an African American board game, comprising selecting a playing card from a plurality of playing cards corresponding to a subject category and a time period indicated on a playing section on an African American game board, wherein the subject category and time period include a subject category and an African American cultural time period;

selecting a numeric code from a plurality of numeric codes on the selected playing card, wherein the plurality of numeric codes and are used to retrieve question and answer data from a hand held audio-visual device included with the game board, wherein the hand held audio-visual device displays audio, video and electronic textual information for question and answer data including the subject categories and African American cultural time periods from non-volatile storage on the hand held audio-visual device and wherein the non-volatile storage on the hand held audio-visual device is also used for storing the plurality of numeric codes, wherein a selected numeric code manually entered into the hand-held audio video device is used to retrieve question and answer data from the non-volatile storage corresponding to the numeric code, wherein the hand held audio-visual apparatus includes separate specialized buttons one specifically for selecting audio snippets and one specifically for selecting video snippets to be played, and wherein the specialized buttons are also used repeating an audio snippet or video snippet after it has been played and used for providing additional audio clues or visual clues for retrieved question and answer data when the specialized buttons are pushed additional times, wherein new or additional question and answer data and more complex question and answer data are stored on one or more external servers on a communications network, wherein the complex question and answer data includes and longer audio and video snippets to large to be stored in the original non-volatile storage, wherein the one or more external servers on the communications network are accessed on the hand held audio-visual device via the one or more interface ports during game play thereby providing new or additional question and answer data and more complex question and answer data that did not exist at a time the non-volatile storage was created or was too large to be stored in the non-volatile storage on the hand held audio-visual device, wherein new or additional question and answer data and the more complex questions and answer data is obtained either directly or randomly from the one or more external servers instead of from the non-volatile storage during game play wherein the non-volatile storage can be re-programmed with new or additional question and answer data or more complex question and answer data via the interface port;

entering manually the selected numeric code into the hand held audio visual device to display question and answer data including a question with a plurality of answer selections and wherein the question data includes electronic text, and a related audio snippet or a video snippet, wherein the plurality of numeric codes includes a plurality of four-digit numeric codes grouped by the subject categories and the time periods for the subject categories.

13. The method of claim 12 wherein the subject category includes history, language, including slang, movies, music, television and radio or sports from African American culture.

14. The method of claim 12 wherein the plurality of numeric codes includes a plurality of four-digit numeric codes are grouped by subject categories and time periods for the subject categories.

15. The method of claim 12 wherein the a plurality of playing cards include subject categories and time periods in a plurality of rows and columns and wherein the plurality of numeric codes are placed at a plurality of intersections of the plurality of rows and columns and wherein the plurality of numeric codes are used to retrieve a desired question and answer related to a selected subject category and an African American cultural time period from non-volatile storage on the hand held audio-visual device.

16. The method of claim 12 wherein the plurality of numeric codes are manually entered via an alpha numeric key-pad on the audio-visual apparatus to retrieve question and answer data that is displayed on the display or on the speaker.

17. The method of claim 12 wherein the step of entering the selected numeric code into the hand held audio visual device to display question and answer data includes displaying question and answer data including electronic text information on a first portion of a display on the audio-visual device and displaying video information on a second portion of the display of the hand held audio-visual device.

18. The method of claim 12 wherein the hand held audio-visual device comprises an integral display, an alpha numeric key-pad, a speaker, a processor, one or more interface ports, power source and non-volatile storage for storing audio, video and electronic textual information for question data including subject categories and time periods related to African American culture and wherein the non-volatile storage is used for storing the plurality of numeric codes, wherein a selected numeric code entered into the hand held audio video device is used to retrieve question and answer data from the non-volatile storage corresponding to the numeric code.

19. An African American board game system, comprising in combination:

a game board playing means having a playing surface divided into a plurality of sections, each section comprising a subject category related to an African American cultural time period for the subject category;

a numeric code selection means including a subject category related to the African American cultural time period for the subject category, wherein a numeric code is selected from a plurality of numeric codes used to retrieve question and answer data from an audio-visual means displayed as electronic text, audio snippets or video snippets, wherein the wherein the plurality of numeric codes includes a plurality of four-digit numeric codes grouped by the subject categories and the time periods for the subject categories and;

a hand held audio-visual means included with the game board playing means comprising a display, an alpha numeric key-pad, a speaker, a processor, one or more interface ports, a power source and non-volatile storage for storing audio, video and electronic textual information for question data including the subject categories and the African American cultural time periods and wherein the non-volatile storage is used for storing the plurality of numeric codes, wherein a selected numeric code manually entered into the hand held audio video means is used to retrieve question and answer data from the non-volatile storage corresponding to the numeric code, wherein the hand held audio-visual apparatus includes separate specialized buttons one specifically for selecting audio snippets and one specifically for selecting video snippets to be played, wherein the hand held audio-visual apparatus includes specialized buttons for selecting audio snippets and video snippets to be played, wherein the specialized buttons are also used repeating an audio snippet or video snippet after it has been played and used for providing additional audio or visual clues for retrieved question and answer data when the specialized buttons are pushed additional times, and wherein a shape of the hand held audio-visual means comprises a shape of profile of a non-historical, historical or a fictional African American person, wherein new or additional question and answer data and more complex question and answer data are stored on one or more external servers on a communications network, wherein the complex question and answer data includes and longer audio and video snippets to large to be stored in the original non-volatile storage, wherein the one or more external servers on the communications network are accessed on the hand held audio-visual device via the one or more interface ports during game play thereby providing new or additional question and answer data and more complex question and answer data that did not exist at a time the non-volatile storage was created or was too large to be stored in the non-volatile storage on the hand held audio-visual device, wherein new or additional question and answer data and the more complex questions and answer data is obtained either directly or randomly from the one or more external servers instead of from the non-volatile storage during game play wherein the non-volatile storage can be re-programmed with new or additional question and answer data or more complex question and answer data via the interface port.

* * * * *